United States Patent [19]

Skierski

[11] 4,150,451

[45] Apr. 24, 1979

[54] DIE HOLDER ASSEMBLY

[75] Inventor: Edwin J. Skierski, Campbellsville, Ky.

[73] Assignee: USM Corporation, Farmington, Conn.

[21] Appl. No.: 882,880

[22] Filed: Mar. 1, 1978

[51] Int. Cl.[2] ..... B21K 1/44; B23G 9/00

[52] U.S. Cl. ..... 10/9; 10/21; 10/24

[58] Field of Search ..... 10/4, 9, 21, 24, 35, 10/40, 53, 61, 70, 85

[56] References Cited

U.S. PATENT DOCUMENTS

| | | | |
|---|---|---|---|
| 2,227,810 | 1/1941 | Mitchell | 10/24 |
| 3,241,353 | 3/1966 | Putetti | 10/24 X |
| 3,398,413 | 8/1968 | Skierski | 10/21 X |
| 3,407,642 | 10/1968 | Hall | 10/24 X |
| 3,815,166 | 6/1974 | Sygnator | 10/21 X |

FOREIGN PATENT DOCUMENTS

| | | | |
|---|---|---|---|
| 595585 | 4/1960 | Canada | 10/24 |
| 102342 | 12/1923 | Switzerland | 10/24 |
| 252195 | 5/1926 | United Kingdom | 10/24 |

*Primary Examiner*—E. M. Combs

*Attorney, Agent, or Firm*—Carl E. Johnson; Richard B. Megley; Vincent A. White

[57] ABSTRACT

An easily assembled and disassembled die holder assembly of the wedge locking type is provided which tightly clamps a punch die in its pocket. A die-engaging wedge of the assembly has an angular protrusion bearing on a wall of a corresponding groove in a side of the die to clamp it downwardly in the die pocket upon take-up of a threaded fastener. A locking wedge acted on by the fastener bears on the die wedge, relative angles of the latter and the protrusion causing the protrusion to hold the die rigidly. Backing off the fastener permits a resilient member to free the die from the protrusion of the die-engaging wedge.

12 Claims, 4 Drawing Figures

DIE HOLDER ASSEMBLY

BACKGROUND OF THE INVENTION

This invention relates to means for accurately mounting and locking dies in operating position. While the invention will hereinafter be described for purposes of illustration as applied to a punch press, for instance a machine for pinch-pointing screws, it will be understood that application of the invention is not thus limited.

In U.S. Pat. No. 3,398,413 issued Aug. 27, 1968, in my name, there is shown and described, with particular reference to FIG. 4 thereof, a pair of complemental dies relatively movable to pinch-point metal blanks. Each die is disclosed as being located and secured in a pocket of a die holder by means of a clamping screw having a conical end received in a conical recess in the die, the axes of the screw and the recess being offset to precisely maintain the operating positions of the dies.

While the patented arrangement has been found to work well in high speed screw pre-pointing machines, the advent of drill screws and other factors, has necessitated the use of higher forming pressures on the dies thus tending to put strain on the clamping screws and to work each die with resultant fret corrosion of its die pocket. To attain rigid holding of a die by a means convenient to use is critical. Resorting to a larger size of clamping screw unfortunately does not solve the problem of providing greater die holding power since to do so within the space limits available (and allowable due to other elements of the machine) necessitates a larger hole and the consequently weakened pocket is likely to break thereat.

SUMMARY OF THE INVENTION

It accordingly is an object of this invention to provide an improved die holder assembly for rigidly locking a die in fixed operating position and comprising only a few easily assembled and disassembled parts.

A further object of the invention is to provide in a punch-die holding assembly a novel combination of wedging means under the control of a single fastener for enabling reliable gripping and holding of a die.

To these ends the invention features a die holder formed with a die-receiving pocket having side and bottom walls preferably in right angle relation, a die wedge having a first die-engaging face formed with an isosceles protrusion for mating with a slightly larger groove of corresponding shape in the die to be secured, the die wedge having a second face spaced from the bottom wall of the pocket when the protrusion is fully engaged with the wall of the groove and a third face extending at an acute angle to the first face, which angle is less in inclination than that of the equal sides of the protrusion relative thereto, a locking wedge complemental to the die wedge and engageable with the third face, and a fastener secured to the holder for causing the locking wedge to bear on the third face thereby causing the protrusion to exert holding pressure on the die in the pocket.

Preferably, and as herein shown, the angle which is defined by the first and third die wedge faces referred to may be on the order of 15°, for instance, while the protrusion sides may project at an angle of about 45° (or the supplement angle of 135°)from the first face. Advantageously the fastener may be a single screw the tightening of which, by reason of the difference in magnitude of the angles referred to, forces the die wedge into anchoring engagement in the die groove firmly to lock the die against the side and bottom walls of the die pocket.

BRIEF DESCRIPTION OF THE DRAWINGS

The foregoing and other features of the invention will now be more particularly described in connection with an illustrative embodiment, and with reference to the accompanying drawings thereof, in which.

DESCRIPTION OF THE PREFERRED EMBODIMENT

Attainment of precision metal forming operations by a punch press on harder work blanks with harder dies and at faster rates over longer operating periods necessitates that forming dies be located with accuracy initially in a die pocket and that they then be rigidly locked therein against relative displacement.

Figure 1:
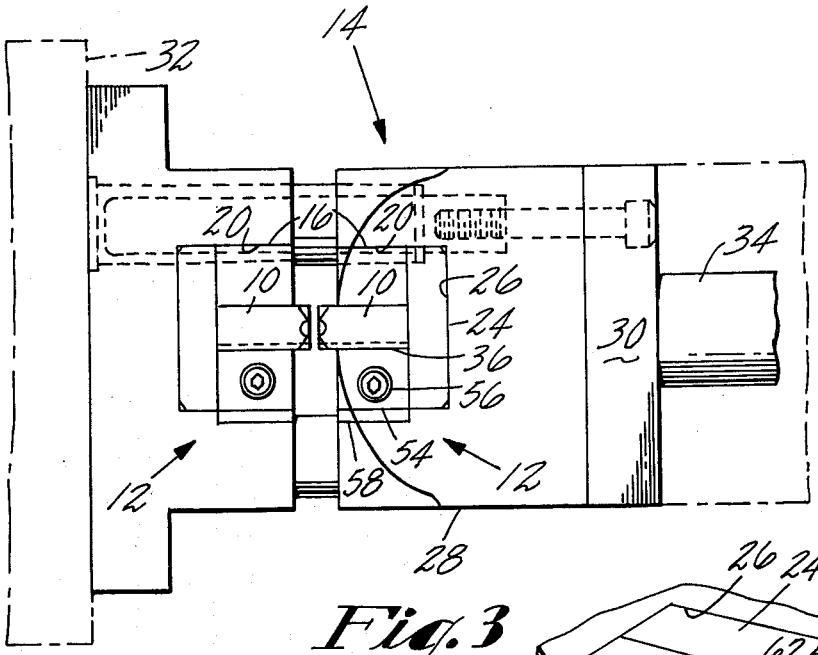
FIG. 1 is a plan view of a die press of a type corresponding generally to that shown in the mentioned U.S. Pat. No. 3,398,413, FIG. 4, and showing a pair of my novel die holding assemblies, the dies largely resembling those of the patent only for purposes of easy comparison.

While a pair of exemplary complemental dies 10,10 is shown in FIG. 1 as mounted for pinch-pointing metal screws, it is to be understood that interchangeable dies of other form, indeed other working tools, may be mounted by my novel work holding assemblies generally designated 12, one of which will next be described as employed in a press 14.

The assembly 12 comprises an L-shaped holder 16 providing a pocket for receiving the die 10 to be held rigidly locked therein during metal forming operations. The pocket is partly defined by a die-engageable side wall 20 and, at preferably right angle relation a bottom wall 22. As in the above-cited patent, the holder 16 and a spacer block or die set 24 are supported in a vertically formed recess 26 in a U-shaped block 28 carrying a pair of laterally disposed guide pins (one shown in FIG. 1). The holder 16 and the block 24 are bolted to the block 28. The latter is detachably secured to a head 30 which may be moved toward and from its counterpart head 32 as by means of a ram 34.

Figure 2:
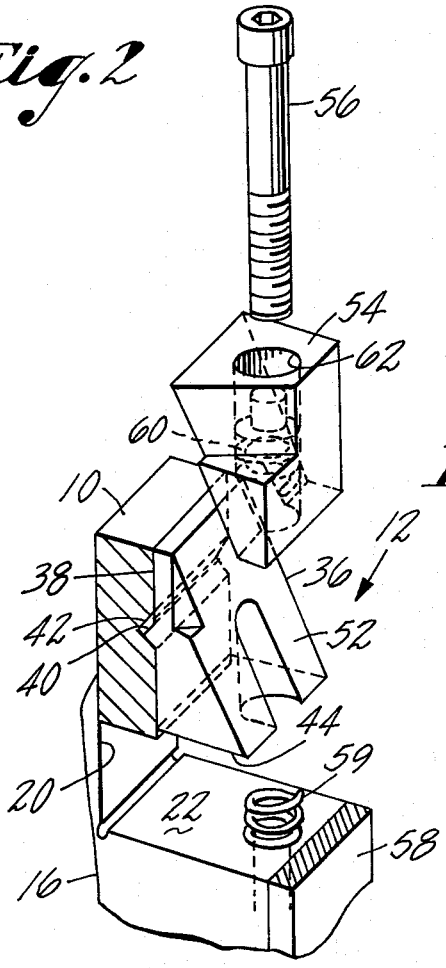
FIG. 2 is an exploded perspective view on a larger scale of parts shown in FIG. 1 for securing and releasing each of the dies.

For locking the die 10 in its operating position (shown in FIG. 1), a truncated die wedge 36, preferably generaly trapezoidal in section as shown in FIG. 2, has a first die-engaging face 38 formed about midheight of the die pocket with an isosceles protrusion 40. This protrusion is arranged to mate with a slightly larger groove 42 of corresponding shape in the die when the die abuts the bottom wall 22 of the pocket, a bottom or second face 44 of the die wedge 36 then being spaced slightly (on the order of 1/32", for instance) from the level of the pocket bottom wall 22.

Figure 4:
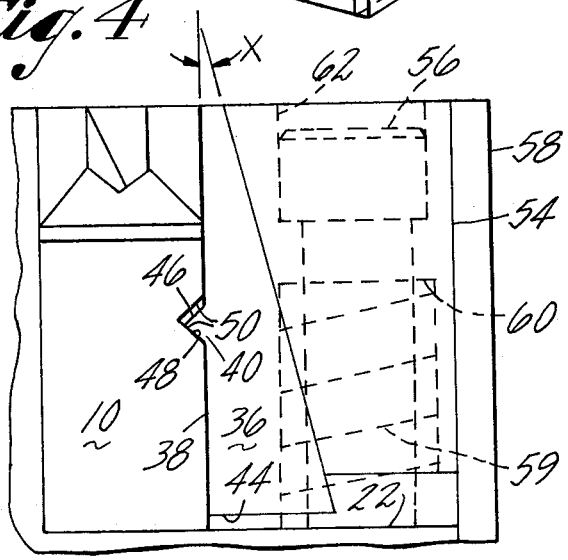
FIG. 4 is a further enlarged view in front elevation of the die holder.

Preferably, and as herein shown in FIG. 4, the protrusion 40 and the groove 42 have vertices of 90°, and accordingly the upper and lower protrusion sides 46,48, respectively, as well as corresponding upper and lower groove faces 50,50, extend with an inclination of about 135° to the die wedge first face 38. In section, then, the protrusion and groove may be considered, in a preferred form, to be isosceles right-triangular to enable the die wedge to most effectively clamp the die and rigidly hold it as will be described. A third face 52 of the die wedge 36 extends at an acute angle X (FIG. 4) to the first face, which angle is less in inclination to the first face than that of the sides of the protrusion 40 relative thereto. The angle X may desirably be on the order of about 15°, for example, when the protrusion and groove sides incline 45° to the first face 38.

The assembly 12 further comprises a locking wedge 54 complemental to the die wedge 36 and engageable with its third face 52. The locking wedge is likewise preferably trapezoidal in section as shown in FIG. 2. Downward pressure, i.e. toward the bottom wall 22 of the die pocket, is exerted by the locking wedge against the third face 52 by means of tightening a threaded fastener, preferably a socket head cap screw 56 recessed in the wedge 54 and threaded into the holder 16, the screw freely extending through a slot in the die wedge 36. Plate 58 is a hardened tool steel wear plate provided to prevent the locking wedge 54 from scoring the die set 24, which is of softer material. When the screw 56 is backed out, it enables a compressed spring 59 on the screw and confined by engagement with a shoulder 60 formed in the bore 62 of the wedge 54 and receiving the screw to tend to lift the locking wedge 54 for a purpose about to be explained.

Figure 3:
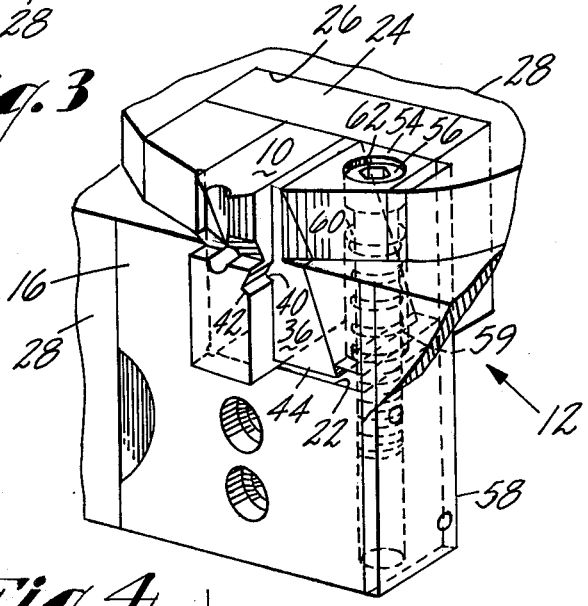
FIG. 3 is a perspective view of a die held in its pocket by the parts shown in FIGS. 2 and 2.

Operation of the die holder assembly 12 will now be briefly reviewed. The die 10 is placed in the holder 16 as shown in FIG. 3, the wholly flat side of the die engaging the pocket side wall 20, and the inner end of the die abutting the pocket bottom wall 22. Next the die wedge 36 is positioned with its protrusion 40 at least loosely received in the die groove 42. Then the locking wedge 54, together with the screw 56 and the spring 59 thereon, are inserted as illustrated, the locking wedge slidably bearing against the third face 52 and the inside of the wear plate 58 which normally remains affixed to the holder 16.

The screw 56 is tightened to compress the spring 59, and more significantly, to bring the locking wedge to bear with pressure against the third face 52 of the die wedge 36. By reason of the difference in the inclination (angle X) of the face 52 (15° to the vertical in FIG. 4). and the greater inclination to the vertical of the sides of the protrusion 40 and of the groove 42 (preferebly 45°), the screw tightening forces the protrusion into the groove. This is to say that, as shown in FIG. 4, the lower face 48 of the protrusion is caused to press on the corresponding lower face 50 of the die groove to hold the die 10 rigidly locked downwardly against the pocket bottom wall 22. In the course of exerting this die clamping pressure, the die wedge 36 does not abut the wall 22, there being an intervening space, for instance, of about 1/32". The die is thus being very securely held downward in its die pocket by the tightened screw 56. When the screw is backed out, the spring 59 lifts the locking wedge 54 relative to the holder 16 thus permitting the die wedge protrusion 40 to slide out of the groove 42 and allowing the second face 44 of the wedge 36 to engage the pocket bottom wall 22. Now the die 10 is free to be removed from the holder assembly.

It will be appreciated from the foregoing that the invention provides an economical and compact construction insuring rigid clamping of the die. Obviously the several parts may be suitably adapted by change in size and, to some extent, in shape and angular relation in order to accommodate and tightly grip different work pieces without departing from the scope of the invention or the effective way in which a die is locked in its pocket.

Having thus described my invention, what I claim as new and desire to secure as Letters Patent of the United States is:

1. A die holder assembly comprising a die holder formed with a die-receiving pocket having a bottom and a side wall, a die wedge formed with an angular protrusion on a first face thereof and adapted to mate with at least a portion of a wall of a substantially correspondingly shaped groove in the die which is to be rigidly locked in the pocket, the groove being larger in transverse section than the protrusion, the die wedge having another face extending at an acute angle to the first face which angle is less in inclination than the inclination of said wall of the groove engaged by the protrusion with respect to said first face a locking wedge having a surface complemental to said other face of the die wedge for bearing thereon, and fastener means secured to the holder for causing the locking wedge to force the protrusion into the die groove and against the wall thereof whereby the die is rigidly clamped in the pocket against its bottom wall.

2. An assembly as in claim 1 wherein the fastener means is a single screw.

3. An assembly as in claim 1 wherein the die wedge protrusion and the die groove have the form of substantially isosceles triangles in cross section.

4. An assembly as in claim 1 wherein the die wedge and the locking wedge are respectively trapezoidal and have inner bottom faces substantially parallel to the bottom pocket wall, the inner bottom face of the die wedge being close to, but slightly spaced from the bottom pocket wall when a wall of the groove is engaged by said protrusion.

5. An assembly as in claim 1 wherein said protrusion and groove respectively have a vertex of 90°.

6. An assembly as in claim 1 wherein the inclination of said other face of the die wedge to its first face is about 15°, and the inclination of the wall of the groove engaged by the protrusion with respect to said first face of the die wedge is two to three times greater.

7. An assembly as in claim 1 wherein, in transverse section, the protrusion and the groove are isosceles right triangles.

8. An assembly as in claim 1 wherein a compression spring confined at least partly in the holder by engagement therewith of the fastener means is arranged to engage the locking wedge, the arrangement being such that, upon loosening of the fastener means, the locking wedge is relatively lifted in the die pocket to enable freeing of the die therein.

9. An assembly as in claim 1 wherein the protrusion is disposed substantially mid-way of said first face.

10. A die holder assembly for use in a punch press comprising a die holder having a die-receiving pocket partly defined by a side wall and a bottom wall at a right angle thereto, a truncated die wedge having a first face to be disposed parallel to the pocket side wall, a second face spaced slightly from the pocket bottom wall during usage of the assembly, and a third face extending at an acute angle to the first face, the first die wedge face being formed with a protrusion having a vertex extending substantially parallel to said pocket bottom wall and disposed to mate with at least a portion of a wall of a correspondingly shaped groove in a die to be locked thereby against the bottom wall of the die pocket, a locking wedge engageable with the third face to cause the die wedge protrusion to exert a clamping force against said wall of the groove thus to lock the die downwardly in its pocket against the bottom wall, and a single, headed fastener threaded into the holder and received in a bore of the locking wedge releasably to maintain said clamping force.

11. An assembly as in claim 10 wherein the acute angle of the third face to the first face is about 15° and the vertices of the protrusion and the groove are each about 90° while their inclinations to said first face are about 45°.

12. An assembly as in claim 11 wherein the locking wedge is truncated, and a hardened wear plate is secured to the outside of the holder for slidably abutting a face of the locking wedge.

* * * * *